US008454296B2

(12) United States Patent
Gerber et al.

(10) Patent No.: US 8,454,296 B2
(45) Date of Patent: Jun. 4, 2013

(54) PIPE-HANDLING APPARATUS AND METHODS

(75) Inventors: Andrew Gerber, Calgary (CA); Douglas A. Hunter, Calgary (CA)

(73) Assignee: Canrig Drilling Technology Ltd., Houston, TX (US)

( * ) Notice: Subject to any disclaimer, the term of this patent is extended or adjusted under 35 U.S.C. 154(b) by 0 days.

(21) Appl. No.: 13/269,087

(22) Filed: Oct. 7, 2011

(65) Prior Publication Data

US 2012/0027541 A1 Feb. 2, 2012

Related U.S. Application Data

(63) Continuation of application No. 12/023,730, filed on Jan. 31, 2008, now Pat. No. 8,033,779.

(51) Int. Cl.
*B65G 1/0442* (2006.01)
*B65G 25/02* (2006.01)
*E21B 19/15* (2006.01)

(52) U.S. Cl.
USPC ..... 414/745.9; 198/468.6; 198/777

(58) Field of Classification Search
USPC ..... 134/134, 160; 193/40; 198/168.7, 198/468.1, 468.11, 468.3, 468.5, 468.6, 468.7, 198/531, 543, 777, 751; 221/271; 414/22.51–22.59, 22.62, 745.4–745.9, 746.1, 414/746.4
See application file for complete search history.

(56) References Cited

U.S. PATENT DOCUMENTS 2,059,351 A * 11/1936 Holland et al. ..... 134/66
2,091,921 A * 8/1937 Greer ..... 134/83
2,114,974 A * 4/1938 Camerota ..... 118/699
2,405,141 A * 8/1946 Hibbard ..... 408/70
2,615,544 A 10/1952 Rynders
2,617,547 A * 11/1952 Pridy ..... 414/746.2
2,643,006 A 6/1953 King
2,751,781 A * 6/1956 McConnell ..... 73/49.6
2,880,881 A 4/1959 Robishaw
3,072,980 A * 1/1963 Ewing ..... 164/298
3,128,893 A 4/1964 Jones
3,159,286 A 12/1964 Freeman, Sr.
3,169,645 A 2/1965 Freeman, Sr.
3,182,816 A * 5/1965 Illo ..... 414/746.4

(Continued)

FOREIGN PATENT DOCUMENTS

CA 1185228 5/1982
CA 1195241 11/1982

(Continued)

OTHER PUBLICATIONS

U.S. Appl. No. 12/098,151, filed Apr. 4, 2008, Gerber et al.

(Continued)

*Primary Examiner* — Gregory Adams
(74) *Attorney, Agent, or Firm* — Haynes and Boone, LLP

(57) ABSTRACT

Apparatus and methods for moving a tubular member to and from an elevated drilling rig floor. A support structure has an elongate indentation in its upper surface. A ramp assembly comprises telescoping assemblies having nested tubular elements extendable between retracted and deployed positions, thus forming a guide extending from the elongate indentation towards the drilling rig floor. Indexers may urge the tubular member towards or away from the elongate indentation. Kickers may urge the tubular member into or out of the elongate indentation, and may be operable via actuators which also operate the indexers.

13 Claims, 11 Drawing Sheets

U.S. PATENT DOCUMENTS

| | | | | |
|---|---|---|---|---|
| 3,217,900 | A | | 11/1965 | Kupetzky et al. |
| 3,307,719 | A | | 3/1967 | Martin, Jr. |
| 3,308,968 | A | * | 3/1967 | Harrington ..... 414/745.7 |
| 3,494,483 | A | | 2/1970 | Smart |
| 3,651,959 | A | | 3/1972 | Castela et al. |
| 3,706,347 | A | | 12/1972 | Brown |
| 3,710,961 | A | | 1/1973 | Bomstein |
| 3,780,883 | A | | 12/1973 | Brown |
| 3,785,506 | A | | 1/1974 | Crocker et al. |
| 3,810,553 | A | | 5/1974 | Crocker et al. |
| 3,883,009 | A | | 5/1975 | Swoboda, Jr. et al. |
| 3,883,820 | A | | 5/1975 | Burns et al. |
| 3,894,515 | A | | 7/1975 | Plyler |
| 3,984,007 | A | * | 10/1976 | Birdwell ..... 414/745.7 |
| 4,051,775 | A | | 10/1977 | Watson |
| 4,051,956 | A | | 10/1977 | Teague |
| 4,067,453 | A | | 1/1978 | Moller |
| 4,129,221 | A | | 12/1978 | Moller |
| 4,143,534 | A | | 3/1979 | Hartkopf et al. |
| 4,147,266 | A | | 4/1979 | Corompt |
| 4,235,566 | A | | 11/1980 | Beeman et al. |
| 4,347,028 | A | | 8/1982 | Dugan |
| 4,361,223 | A | | 11/1982 | Johnson |
| 4,379,676 | A | | 4/1983 | Frias |
| 4,380,297 | A | | 4/1983 | Frias |
| 4,382,738 | A | | 5/1983 | Frias |
| 4,386,883 | A | | 6/1983 | Hogan et al. |
| 4,403,898 | A | | 9/1983 | Thompson |
| 4,426,182 | A | | 1/1984 | Frias et al. |
| 4,470,740 | A | | 9/1984 | Frias |
| 4,474,520 | A | | 10/1984 | Buckner et al. |
| 4,494,899 | A | | 1/1985 | Hoang et al. |
| 4,533,055 | A | | 8/1985 | Haney |
| 4,696,207 | A | | 9/1987 | Boyadjieff |
| 4,709,766 | A | | 12/1987 | Boyadjieff |
| 4,765,401 | A | | 8/1988 | Boyadjieff |
| 4,960,356 | A | | 10/1990 | Wrenn |
| 5,077,852 | A | | 1/1992 | Karlsson |
| 5,137,114 | A | | 8/1992 | Yde et al. |
| 5,542,810 | A | | 8/1996 | Florus |
| 6,079,925 | A | | 6/2000 | Morgan et al. |
| 6,533,519 | B1 | | 3/2003 | Tolmon et al. |
| 6,695,559 | B1 | | 2/2004 | Pietras |
| 7,163,367 | B2 | | 1/2007 | Handley |
| 7,300,239 | B2 | | 11/2007 | Benedikt |
| 7,469,749 | B2 | | 12/2008 | Folk |
| 7,473,065 | B2 | | 1/2009 | Wells |
| 7,832,974 | B2 | | 11/2010 | Fikowski et al. |
| 2003/0155154 | A1 | | 8/2003 | Oser |
| 2004/0136813 | A1 | | 7/2004 | Pietras |
| 2004/0197166 | A1 | | 10/2004 | Tolman et al. |
| 2004/0208730 | A1 | | 10/2004 | Morelli et al. |
| 2005/0079044 | A1 | | 4/2005 | Handley |
| 2005/0238463 | A1 | | 10/2005 | Smith |
| 2006/0045655 | A1 | | 3/2006 | Wells |
| 2006/0104746 | A1 | | 5/2006 | Thompson |
| 2006/0124356 | A1 | | 6/2006 | Gust et al. |
| 2006/0285941 | A1 | | 12/2006 | Fikowski et al. |
| 2007/0114113 | A1 | | 5/2007 | Muse et al. |
| 2007/0177967 | A1 | | 8/2007 | Lesko |
| 2007/0193749 | A1 | | 8/2007 | Folk |
| 2007/0221385 | A1 | | 9/2007 | Braun et al. |
| 2007/0286708 | A1 | | 12/2007 | Smith et al. |
| 2009/0252576 | A1 | | 10/2009 | Gerber et al. |
| 2011/0044787 | A1 | | 2/2011 | Fikowski et al. |

FOREIGN PATENT DOCUMENTS

| | | |
|---|---|---|
| CA | 1139299 | 1/1983 |
| CA | 1161427 | 1/1984 |
| CA | 1185228 | 4/1985 |
| CA | 1195241 | 10/1985 |
| CA | 1254194 | 2/1986 |
| CA | 1254194 | 5/1989 |
| CA | 2115810 | 2/1994 |
| CA | 2224638 | 12/1997 |
| CA | 2115810 | 10/1998 |
| CA | 2224638 | 6/1999 |
| CA | 2496440 | 11/2003 |
| CA | 2508998 | 12/2006 |
| CA | 2551884 | 1/2007 |
| EP | 1888872 | 2/2008 |
| WO | WO 2006/128300 A1 | 12/2006 |

OTHER PUBLICATIONS

Operating Manual for the Pipe Handler—machine set-up, 41 pages.
http://www.columbiacorp.com/#/products/pipe-handlers/4-arm-pipe-handler/, Web site Screen Shot, 1 Page.
http://www.columbiacorp.com/#/our-company/video-gallery/, Web site Screen Show, 1 page.
International Search Report WO06/128300 (PCT/CA06/000904).
PCT Written Opinion of the International Searching Authority WO06/128300 (PCT/CA06/000904).
PCT International Preliminary Report on Patentability WO06/128300 (PCT/CA06/000904).

* cited by examiner

PIPE-HANDLING APPARATUS AND METHODS

CROSS-REFERENCE TO RELATED APPLICATIONS

This application is a continuation of U.S. patent application Ser. No. 12/023,730 filed Jan. 31, 2008 now U.S. Pat. No. 8,033,779, now allowed, the contents of which is hereby incorporated herein by express reference thereto.

BACKGROUND

During borehole-forming and completion operations, it is necessary to make up and/or break down long strings of tubular goods such as drill pipe and casing. The string of pipe may be thousands of feet long, and it is therefore necessary to transport pipe joints (approximately 33 to 45 feet in length) from a pipe rack located away from the rig up to the rig floor. When being tripped out of the hole, the string of pipe is broken down into separate joints and returned to the pipe rack.

The handling of oil well pipe is one of the most dangerous jobs on a drilling rig. Some of the pipe joints weigh thousands of pounds, and it is difficult to move the pipe from a horizontal position below and away from the rig into a vertical position overlying hole center in the rig.

SUMMARY OF THE INVENTION

The invention relates to an apparatus for moving a tubular member to and from an elevated drilling rig floor, the apparatus including: a support structure having an upper surface and an elongate indentation extending longitudinally along the upper surface, wherein the elongate indentation is configured to accommodate the tubular member partially therein, and a ramp assembly including first and second side-by-side telescoping assemblies each having at least one outer surface and formed of a plurality of nested tubular elements having a polygonal shape, wherein: a first end of the first telescoping assembly is positionally fixed relative to a first end of the second telescoping assembly; a second end of the first telescoping assembly is detachably coupled to a second end of the second telescoping assembly; the second ends of the first and second telescoping assemblies are extendable between a retracted position and a deployed position proximate the drilling rig floor at a variable height relative to the upper surface of the support structure; and the at least one outer surface of each of the first and second telescoping assemblies collectively form at least a portion of an elongate guide extending from the elongate indentation towards the drilling rig floor, wherein a portion of the elongate guide is configured to accommodate and guide the tubular member, and wherein the ramp assembly is configured to guide the tubular member toward the drilling rig floor.

In one preferred embodiment, the polygonal shape of each of the first and second telescoping assemblies includes a round tube. In a more preferred embodiment, each round tube is circular. In yet another preferred embodiment, the polygonal shape is a triangle. In another preferred embodiment, the apparatus of claim 1, wherein the polygonal shape of a tubular element of the first and second telescoping assemblies is the same, and the elongate guide accommodates the tubular member partially therein.

The invention further relates to an apparatus, including a plurality of indexers mounted in a corresponding plurality of recesses in an upper surface of a support structure and cooperatively operable to urge a tubular member towards or away from an elongate indentation in the upper surface of the support structure, a plurality of kickers each operably coupled to a corresponding one of the plurality of indexers and operable to urge the tubular member into or out of the elongate indentation, and a plurality of first and second actuators, wherein each first actuator is operable to raise and lower an outer end of a corresponding one of the plurality of indexers relative to the upper surface of the support structure, each second actuator is operable to raise and lower an inner end of a corresponding one of the plurality of indexers relative to the upper surface of the support structure, and each second actuator is further operable to deploy and stow a corresponding one of the plurality of kickers simultaneously with the raising and lowering, respectively, of the inner end of a corresponding one of the plurality of indexers.

In one embodiment, each of the plurality of first and second actuators includes a hydraulically-operable linear actuator. In another embodiment, each of the plurality of kickers retracts into a corresponding recess in the elongate indentation when stowed and protrudes into the elongate indentation when deployed. In a preferred embodiment, the apparatus further includes a plurality of stop pins positioned at spaced-apart locations along outer edges of the support structure and operable to prevent the tubular member from rolling past the outer edges of the support structure. In a more preferred embodiment, each of the plurality of stop pins is removably detachable.

In another embodiment, the apparatus further includes indexer pipe rollers configured to align the tubular members fore and aft prior to indexing. In yet another embodiment, the plurality of kickers and the plurality of indexers collectively includes a plurality of hydraulically-operable linear actuators each configured to simultaneously operate one of the plurality of indexers and a corresponding one of the plurality of kickers. In yet a further embodiment, the apparatus further includes a skate mechanism operable to move the tubular member within the elongate indentation. In a more preferred embodiment, the skate mechanism further includes a grabbing member operable to engage or push the tubular member in connection with movement of the skate mechanism. In a most preferred embodiment of this aspect, the grabbing member includes a forked portion configured to engage the tubular member.

In another embodiment, the apparatus further includes a ramp assembly including first and second side-by-side telescoping assemblies each having at least one outer surface and formed of a plurality of nested tubular elements, wherein: a first end of the first telescoping assembly is positionally fixed relative to a first end of the second telescoping assembly; a second end of the first telescoping assembly is detachably coupled to a second end of the second telescoping assembly; the second ends of the first and second telescoping assemblies are extendable between a retracted position and a deployed position proximate the drilling rig floor at a variable height relative to the upper surface of the support structure; and the at least one outer surface of each of the first and second telescoping assemblies are adjacent and collectively form at least a portion of an elongate guide extending from the elongate indentation towards the drilling rig floor. In a preferred embodiment, the first and second telescoping assemblies form a first portion of the elongate guide, and wherein the ramp assembly further includes a wedge ramp forming a second portion of the elongate guide extending between the elongate indentation and the first portion of the elongate guide. In a further embodiment, the apparatus further includes a plurality of pipe rack extension arms having first and second ends and configured to extend from the support structure at various lengths and to retract into corresponding recesses in the support structure when not in use.

The invention further relates to a method for moving a tubular relative to a drilling rig floor, which includes: operating a plurality of indexers mounted in a corresponding plurality of recesses in an upper surface of a support structure to urge a tubular member towards or away from an elongate indentation in the upper surface of the support structure; and operating a skate mechanism to move the tubular member within the elongate indentation and within an elongate guide of a ramp assembly, wherein the ramp assembly includes first and second telescoping assemblies each having a plurality of nested tubular elements and extendable between a retracted position and a deployed position that is proximate the drilling rig floor.

In one embodiment, each of the plurality of indexers includes a hydraulically-operable linear actuator, and wherein operating the plurality of indexers includes operating at least one of the hydraulically-operable linear actuators. In another embodiment, the apparatus further includes operating a plurality of actuators to vertically and angularly align the upper surface of the support structure with a proximate storage rack. In a preferred embodiment, each of the plurality of actuators includes a hydraulically-operable linear actuator, and wherein operating the plurality of actuators includes operating at least one of the hydraulically-operable linear actuators.

In yet another embodiment, the apparatus further includes operating a plurality of kickers retracted into a corresponding plurality of recesses in the elongate indentation to urge the tubular member into or out of the elongate indentation. In a preferred embodiment, each of the plurality of kickers is operably coupled to a corresponding one of the plurality of indexers, and wherein operating the plurality of kickers and operating the plurality of indexers collectively includes operating a plurality of hydraulically-operable linear actuators each configured to simultaneously operate one of the plurality of indexers and a corresponding one of the plurality of kickers.

BRIEF DESCRIPTION OF THE DRAWINGS

The present disclosure is best understood from the following detailed description when read with the accompanying figures. It is emphasized that, in accordance with the standard practice in the industry, various features may not be drawn to scale. In fact, the dimensions of the various features may be arbitrarily increased or reduced for clarity of discussion.

DETAILED DESCRIPTION OF PREFERRED EMBODIMENTS

Figure 1:
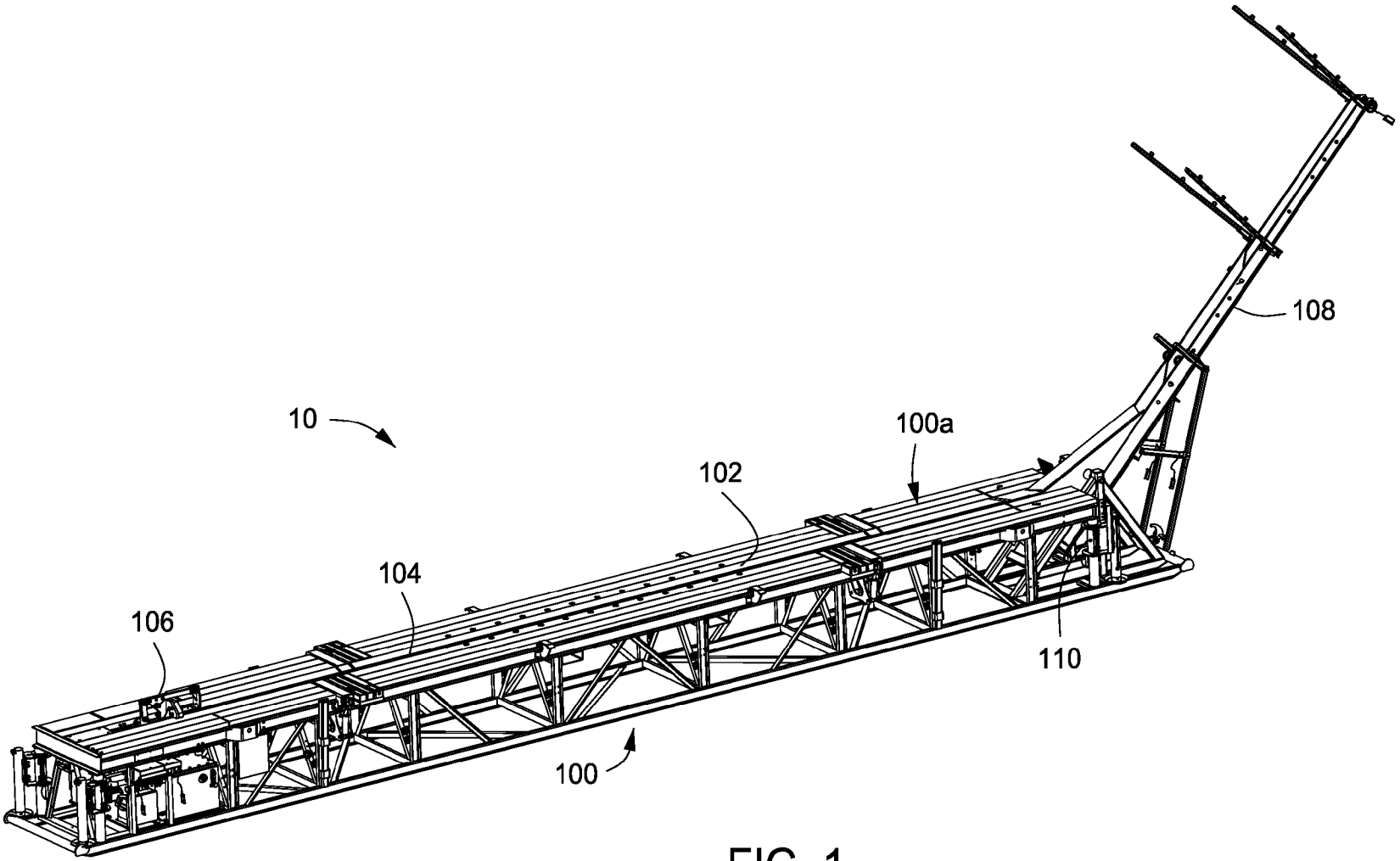
FIG. 1 is a perspective view of apparatus according to one or more aspects of the present.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is a perspective view of an apparatus 10 according to one or more aspects of the present disclosure. The apparatus 10 comprises a support structure 100 including an elongate indentation 102 which extends longitudinally along the upper surface 100*a* of the support structure 100. The indentation 102 is upwardly opening and is configured to accommodate a tubular member therein. The elongate indentation 102 further comprises a slot 104 that extends along a substantial length of the upper surface of the support structure 100. A skate 106 is mounted in the slot 104 and is configured to move in the slot 104 and along a substantial portion of the elongate indentation 102. In an exemplary embodiment, the skate 106 is configured to move the tubular member in an axial or longitudinal direction within the indentation 102. In particular, the skate 106 is operable to push the tubular member along the elongate indentation 102 and up to the rig floor. The skate 106 is further used to support tubular members and pull them down from the rig floor.

The apparatus 10 further comprises a ramp assembly 108 that is configured to guide a tubular member to an elevated position (i.e., a rig floor) relative to the support structure 100. To accomplish this end, a drive system 110 is located under the support structure 100 below the ramp assembly 108 and is designed to move the skate 106 along the elongate indentation 102 thereby repositioning a tubular member towards or away from the elevated position. In an exemplary embodiment, the drive system 110 is powered by a hydraulic winch and cable system. As later and further disclosed in FIGS. 9A and 9B, the cable of the drive system 110 can be actuated to either push or pull a tubular member along the elongate indentation 102 and either up or down the ramp assembly 108.

Figure 2:
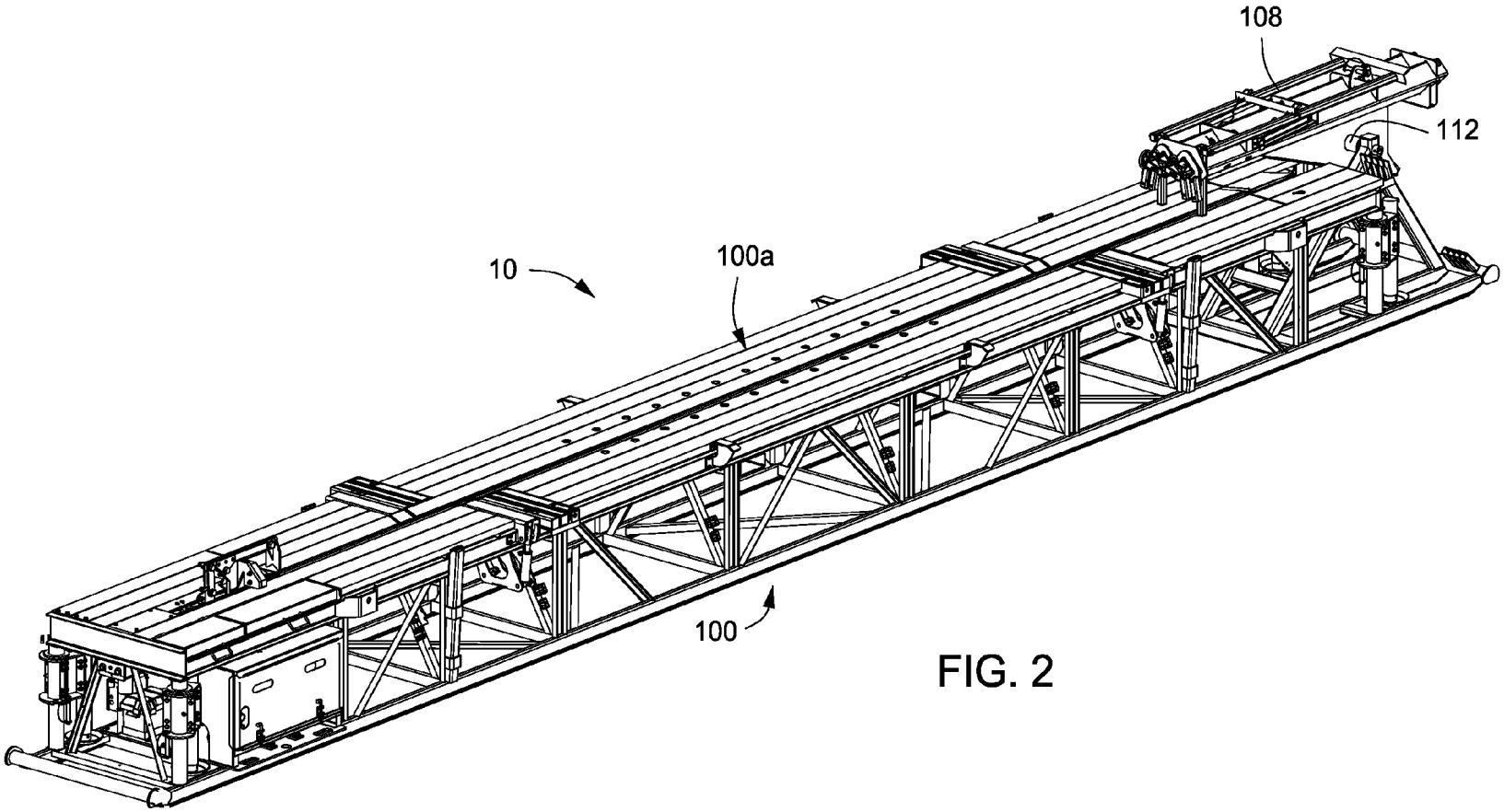
FIG. 2 is a perspective view of the apparatus shown in FIG. 1.

The ramp assembly 108 is rotatably coupled to the support structure 100 thus allowing it to be rotatable between an operational configuration and a transport configuration. FIG. 2 illustrates the support structure 100 and ramp assembly 108 in their transport configuration, in which the ramp assembly 108 is in a folded position, thereby being substantially parallel to the upper surface 100*a* of the support structure 100. In an exemplary embodiment, the ramp assembly 108 is released from the base of the support structure 100, and rotated on a hinged axis 112 that enables the ramp assembly 108 to fold down onto the top surface of the support structure 100.

Figure 3:
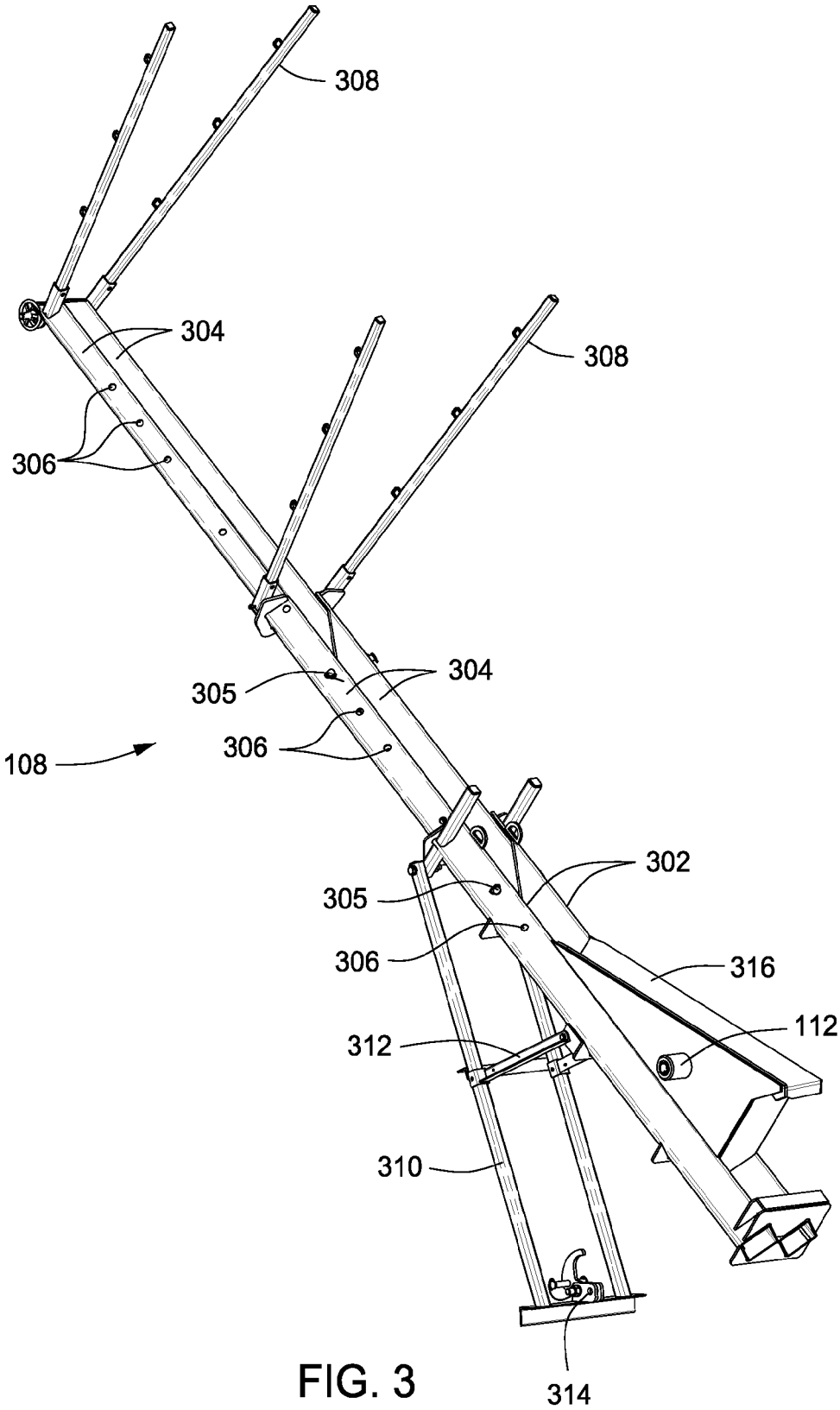
FIG. 3 is a perspective view of a portion of the apparatus shown in FIG. 1.
Figure 4:
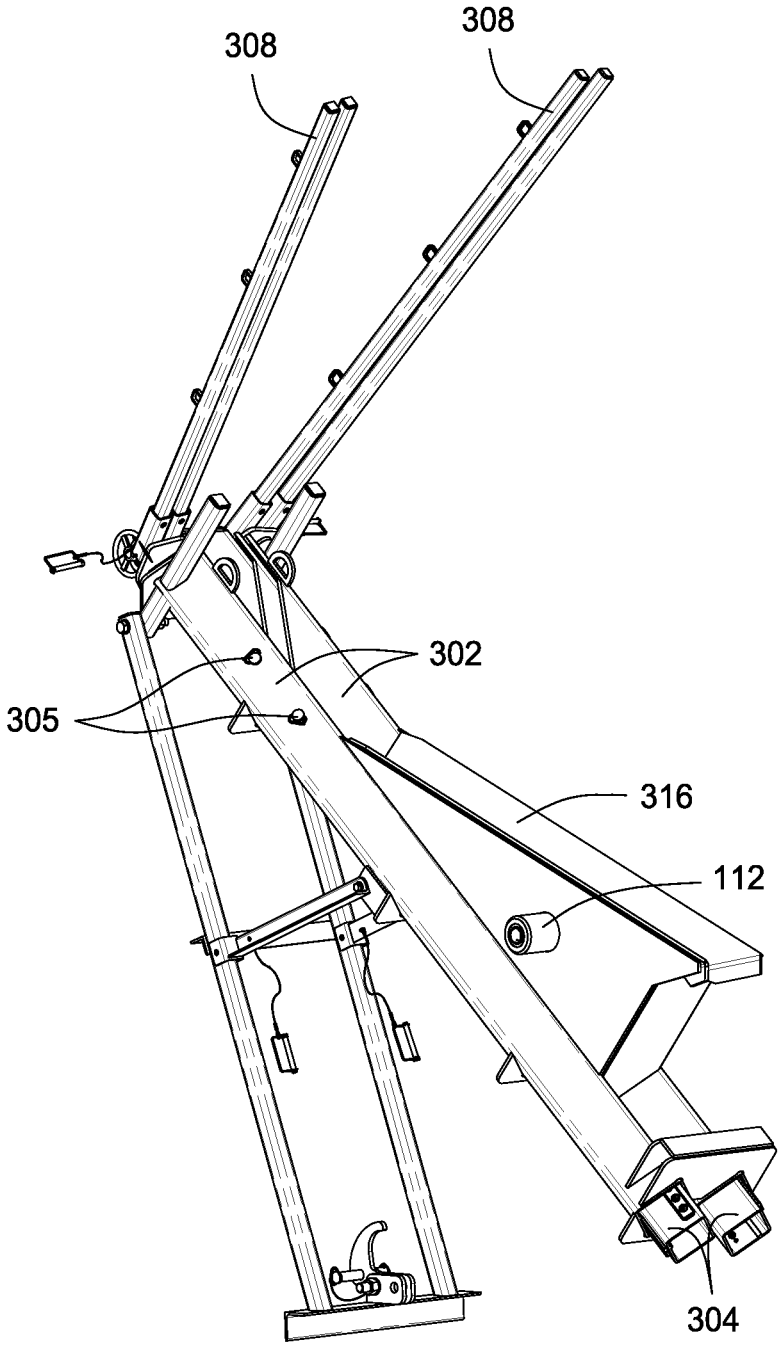
FIG. 4 is a perspective view of the apparatus shown in FIG. 3.

FIGS. 3 and 4 show the ramp assembly 108 in its fully deployed and retracted configurations, respectively. In one embodiment, as illustrated in FIG. 3, the ramp assembly consists of at least two telescoping assemblies 302 each having a plurality of nested tubular elements 304. The tubular elements 304 may comprise square tubes, while other embodiments may employ round tubes or tubes of varying geometry and size. The ramp assembly 108 forms a portion of an elongate guide 502 (shown in FIG. 5) extending from the elongate indentation 102 towards a drilling rig floor. To accomplish this, the tubular elements 304 may also be positionally fixed at one end relative to one another and detachably coupled at the opposing end.

The nested tubular elements 304 may be tubular members of decreasing size coupled together in a sleeve-like configuration. In this manner, the nested tubular elements 304 are capable of sliding in and out of the previous nested element 304 thus being able to extend proximate a drilling rig floor at a variable height relative to the upper surface 100*a* of the support structure 100. The nested tubular elements 304 each include a plurality of holes 306 located along the walls of the tubular element 304 at predetermined locations. In one embodiment, a hole 306 from one nested tubular element 304 can be aligned with a hole 306 from a mating nested tubular element 304 and locked into place by inserting a removable locking pin 305. The locking pin 305 may be configured to extend through the holes 306 of the aligned nested tubular elements 304 to temporarily fix the telescoping assemblies 302 in the deployed (FIG. 3) or retracted (FIG. 4) positions.

The ramp assembly 108 also comprises guide arms 308 located at various distances along the telescoping assemblies 302. The guide arms 308 are configured to guide and maintain tubular members in the elongate indentation 102, 502 of the support structure 100 and ramp assembly 108, respectively, as tubular members are moved up and down the ramp assembly 108. In one embodiment, the guide arms 308 can be removed manually when the ramp assembly 108 is to be folded for transport.

A support member 310 is coupled to the underside of the ramp assembly 108 by means of a brace 312 and is hinged to ramp assembly 108, and can be folded down to the surface of the nested tubular elements 304. A hook locking pin 314 is detachably attached to the base of the support structure 100. The support member 310 is configured to reinforce the ramp assembly 108 against its own weight and the weight of tubular members moving up and down the ramp 108.

Figure 5:
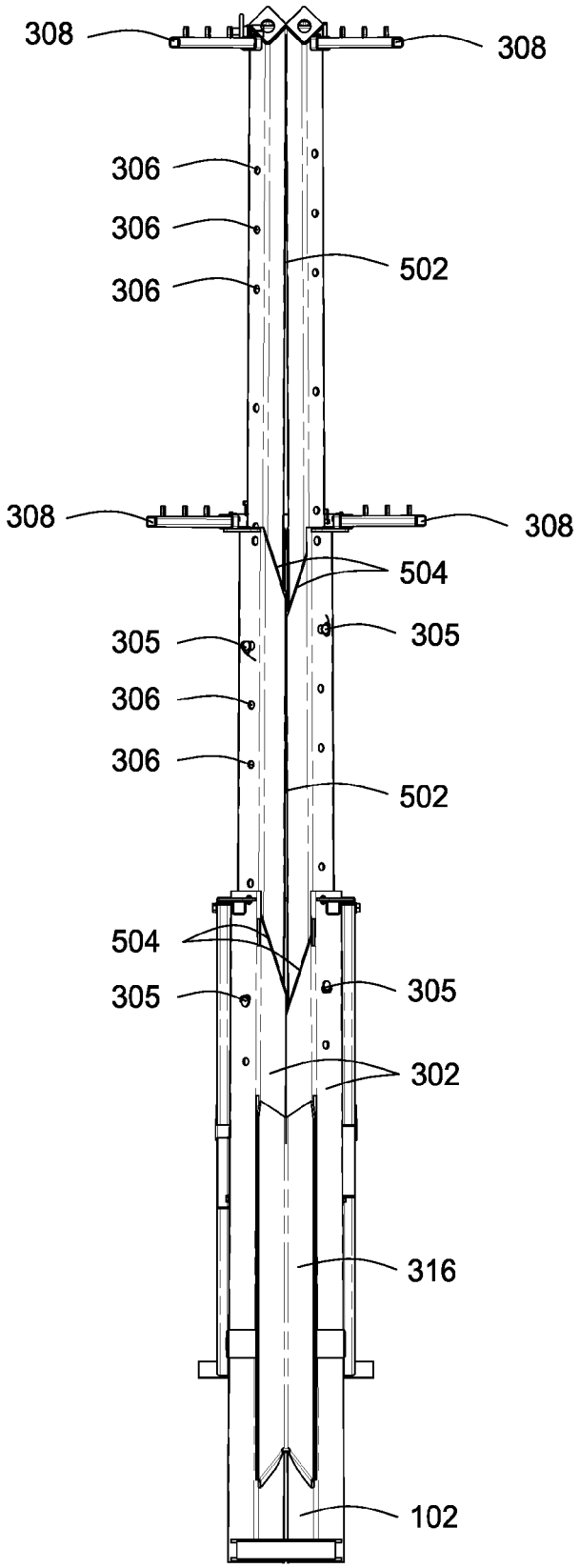
FIG. 5 is a top view of the apparatus shown in FIG. 1.

FIGS. 3-5 further illustrate a wedge ramp 316 which forms a portion of the elongate guide 502 and extends from the elongate indentation 102 towards the drill rig floor. The wedge ramp 316 is configured to provide an angular transition between the elongate indentation 102 and the elongate guide 502 thereby guiding a tubular member to an elevated position relative to the support structure 100.

FIG. 5 further illustrates that ends 504 of the nested tubular elements 304 may be longitudinally staggered relative to a laterally-proximate end of a neighboring one of the nested tubular elements 304 of the telescoping assemblies 302. In an exemplary embodiment, the ends 504 are each angled relative to a longitudinal direction of the elongate guide 502. The stagger and/or angles in the ends 504 are configured to guide a pipe down the deployed nested tubular elements 304 in a continuous motion, without catching an end of a pipe and thereby halting its descent.

Figure 6A:
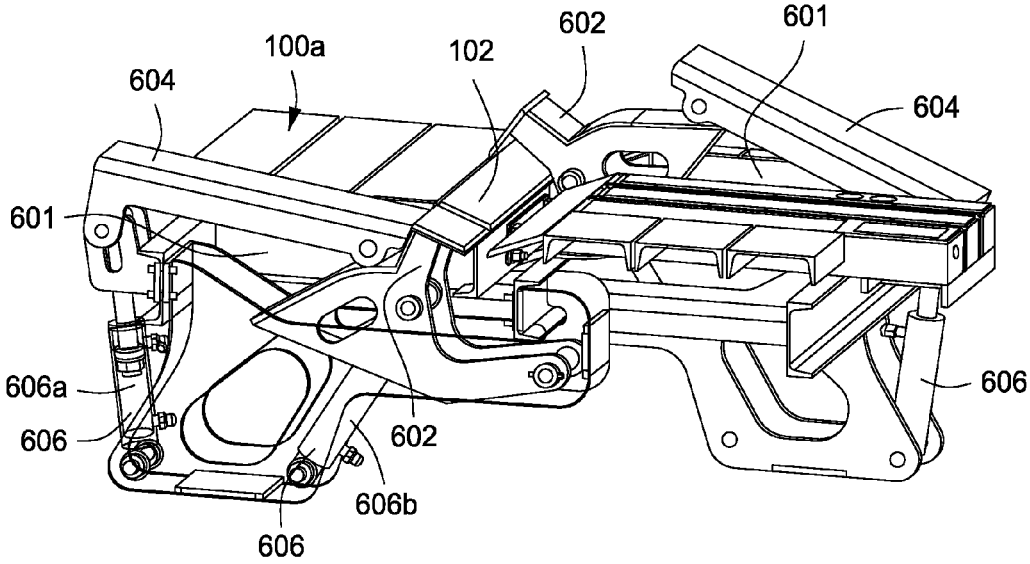
FIGS. 6A and 6B are perspective views of a portion of the apparatus shown in FIG. 1.
Figure 6B:
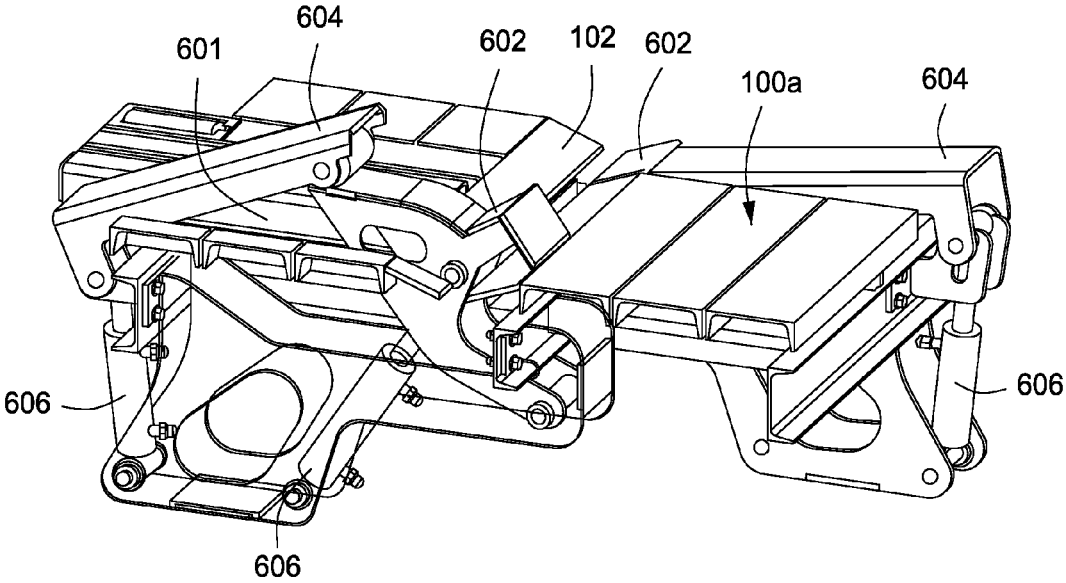

FIGS. 6A and 6B depict kickers 602 and indexers 604 in an exemplary embodiment of the disclosure. When not in use, both the kickers 602 and indexers 604 are mounted in recesses 601 flush with the surface 100*a* of the support structure 100. In an exemplary embodiment, here are four kickers 602 and four indexers 604 that operate in unison to urge tubular members either towards or away from the elongate indentation 102 of the support structure 100. This is accomplished by simultaneously operating a plurality of actuators 606 that are operably coupled to the kickers 602 and indexers 604. In exemplary embodiments, the actuators 606 may be hydraulically-operable linear actuators and for may be powered by pneumatics or a geared electric motor.

In an exemplary embodiment, as depicted in FIG. 6A, one actuator 606*a* is operable to raise or lower an outer end of a corresponding indexer 604 while a second actuator 606*b* is operable to raise and lower an inner end of the corresponding indexer 604, all relative to the upper surface 100*a* of the support structure 100. The actuator 606*b* is further operable to deploy and stow a corresponding kicker 602 simultaneously with the raising and lowering, respectively, of the inner end of the corresponding indexer 604. When not in operation, the kickers 602 are mounted flush with the elongate indentation 102.

Figure 7A:
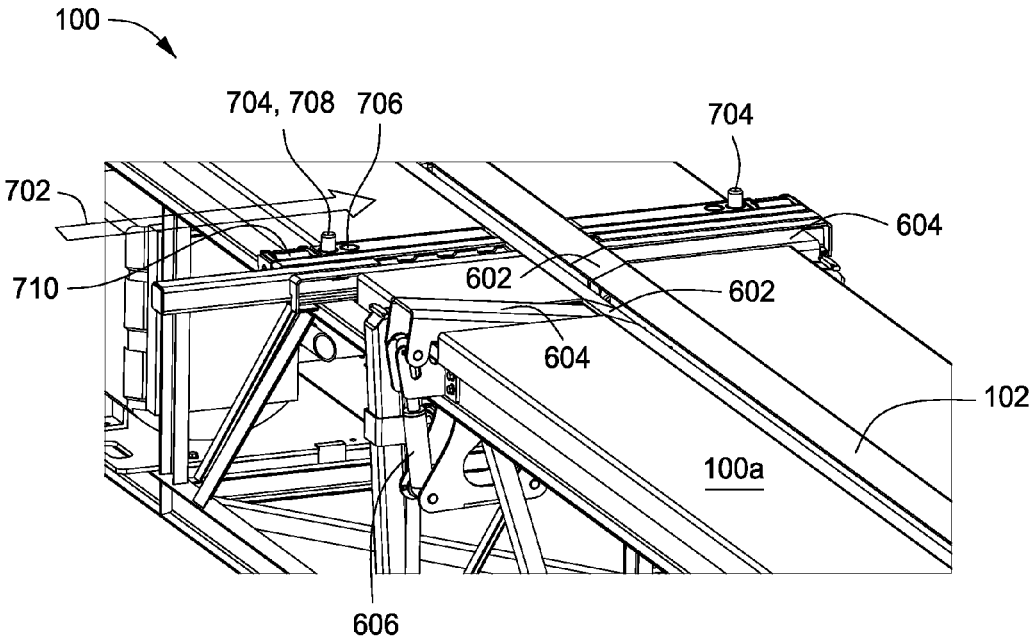
FIGS. 7A-7C are perspective views of a portion of the apparatus shown in FIG. 1.
Figure 7B:
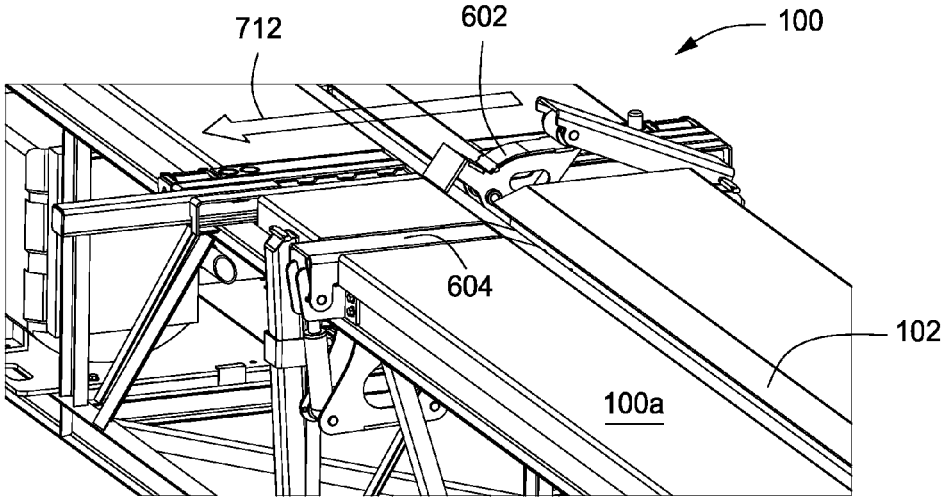
Figure 7C:
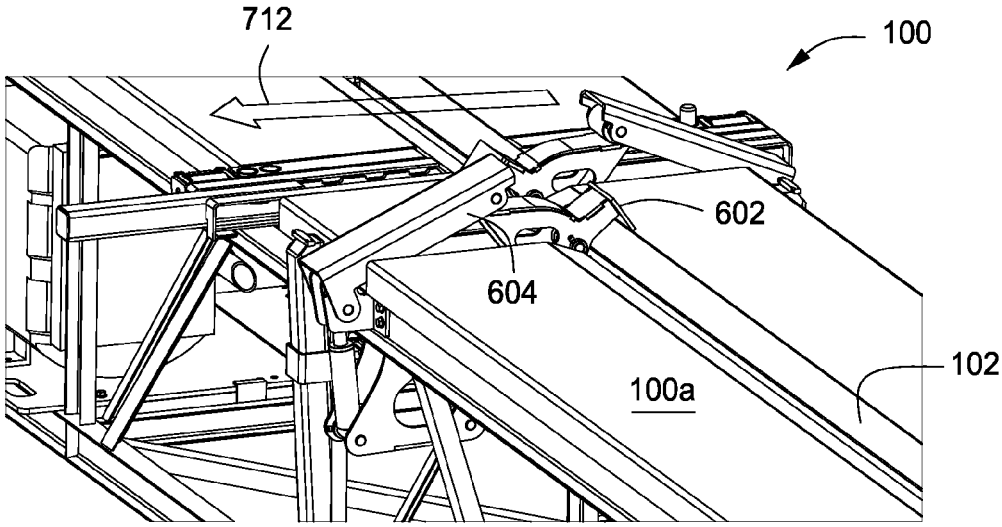

FIGS. 7A-7C illustrate the sequential motion of the kickers 602 and indexers 604 operable to move a tubular member into and out of the elongate indentation 102. The stop pins 704 may be used to hold a tubular member prior to indexing. Each stop pin 704 may be a hollow or solid member having a substantially cylindrical shape configured to be received in a corresponding recess in the upper surface 100*a* of the support structure 100. In an exemplary embodiment, there are a total of four stop pins 704 removably detachable from the support structure 100. Two stop pins 704 are generally positioned on each side of the elongate indentation 102 at predetermined spaced-apart locations. Only two of the possible four stop pin 704 locations are shown in FIGS. 7A-7C. Stop pins 704 may be located at an inner position 706 for larger diameter tubular members and an outer position 708 for smaller diameter tubular members.

Referring to FIG. 7A, a tubular member is introduced parallel to the elongate indentation in the direction 702. Indexer pipe rollers 710 facilitate moving the tubular member fore and aft to align with the skate 106 prior to indexing. Operating the actuator 606 raises the outer end of the indexer 604 on one side of the elongate indentation 102, thus allowing the tubular member to roll over the stop pin 704 and in towards the elongate indentation 102. On the opposing side of the elongate indentation 102, a corresponding stop pin 704 operates to prevent the tubular member from rolling off the support structure 100. The kickers 602 may also be deployed to prevent the tubular member from rolling past the elongate indentation 102.

FIGS. 7B and 7C illustrate an exemplary embodiment of how to eject the tubular member from the elongate indentation 102. In FIG. 7B, operating the kickers 602 on one side of the elongate indentation 102 rolls a tubular member out of the elongate indentation 102 in direction 712 and onto the indexers 604. In FIG. 7C, operating the kickers 602 on the opposite side of the elongate indentation 102 raises the inner end of the corresponding indexers 604 allowing the tubular member to roll off of the upper surface 100*a* support structure 100 in direction 712. A person of ordinary skill in the art will appreciate that this method or process of loading or unloading a tubular member can be accomplished from either side of the elongate indentation.

Figure 8A:
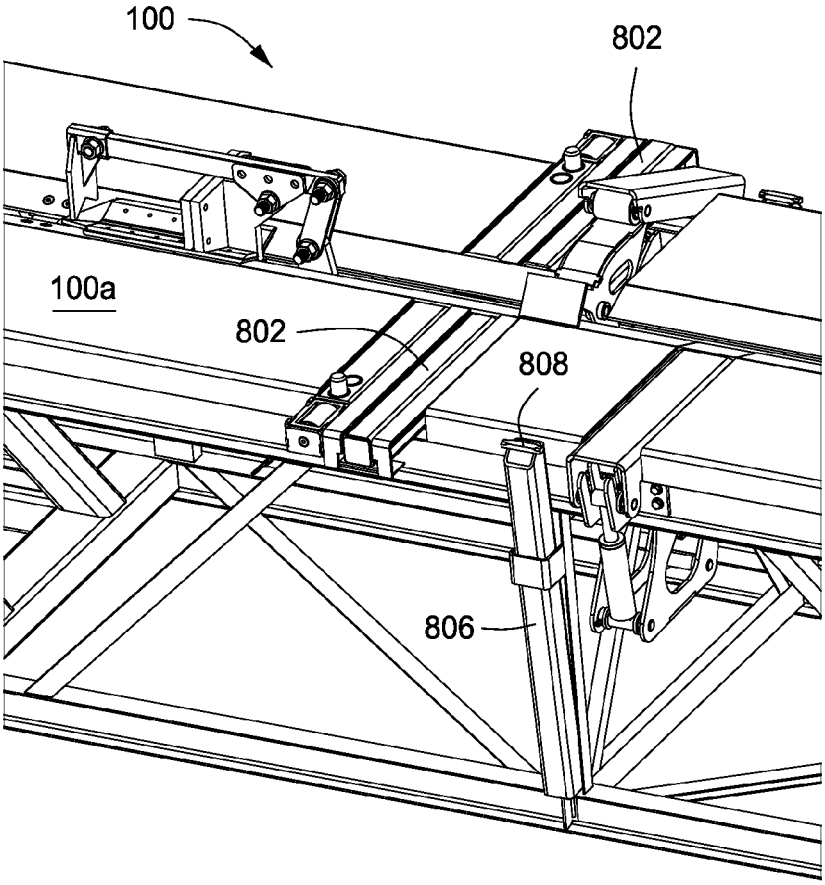
FIGS. 8A and 8B are perspective views of a portion of the apparatus shown in FIG. 1.
Figure 8B:
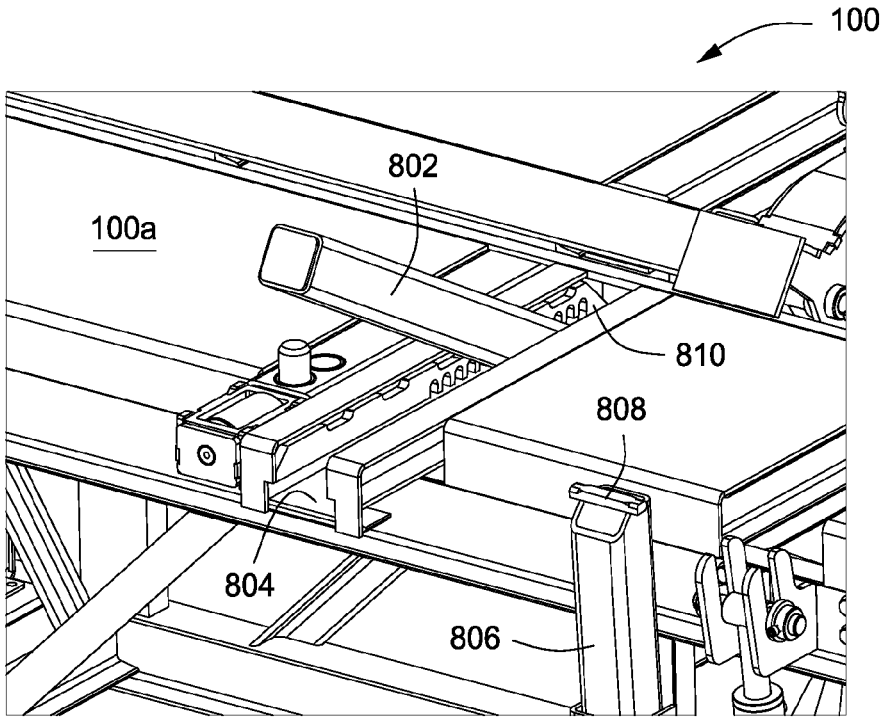
Figure 8C:
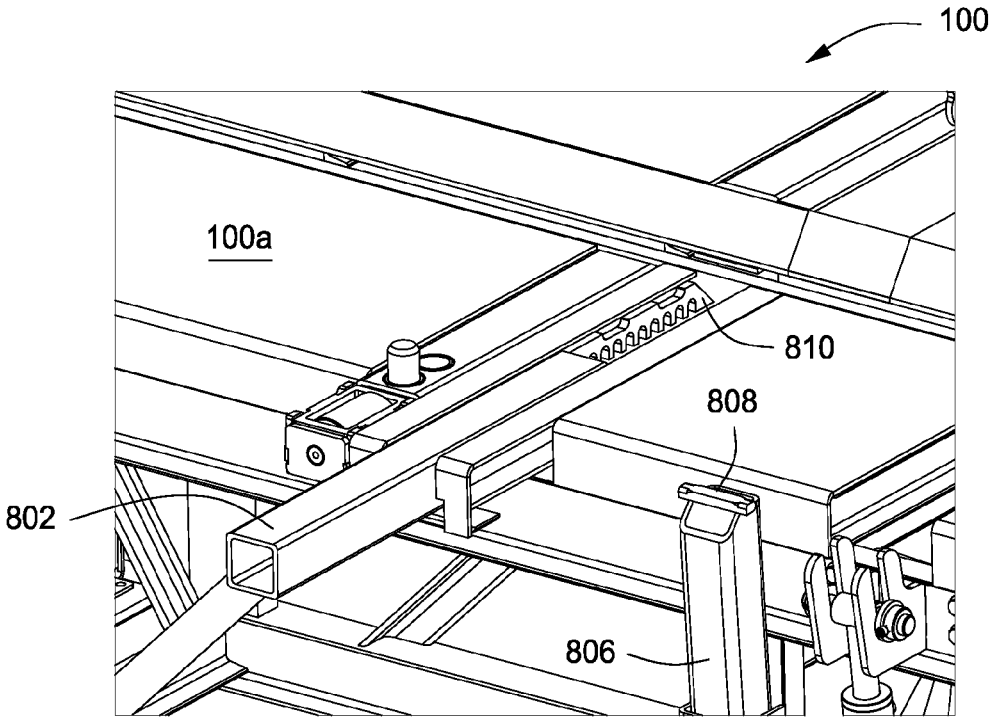
FIG. 8C is a sectional view of a portion of the apparatus as shown in FIGS. 8A and 8B.

Referring now to FIGS. 8A-8C, pipe rack extension arms 802 are configured to extend from the upper surface 100*a* of the support structure 100 to assist in tubular member loading and unloading. When in their extended positions, pipe rack extension arms 802 provide an extended surface from the upper surface 100*a* upon which tubular members may roll to or from a pipe rack. In an exemplary embodiment there are a total of four pipe rack extension arms 802 that can be used on the support structure 100 at any given time, two on either side of the support structure 100. Each pipe rack extension arm 802 is designed to retract into corresponding recesses 804 (see FIG. 8B). Additional pipe rack extension arms 806 are also available and can be stowed away when not in use. In an exemplary embodiment, the additional pipe rack extension arms 806 may provide 12 to 24 inches of additional length, although other lengths are also within the scope of the present disclosure.

The pipe rack extension arms 802 may include a locking pin 808 coupled to one end. The locking pins 808 are configured to coincide and seat in a corresponding rack of locking slots 810 (see FIGS. 8B and 8C). In an exemplary embodiment, the locking slots 810 are spaced apart in one inch (2.54 cm.) increments, although this pitch can be changed to suit the particular application. To adjust the position of the pipe rack extension arm 802, the outboard end of the arm 802 is lifted to an angle sufficient to release the locking pin 808 from the locking slots 810. The extension arm 802 may then be slid outward, and the outer end is lowered to again engage the pin 808 in a new slot 810. To completely remove the pipe rack extension arm 802, the outboard end of the arm 802 is again lifted to an angle sufficient to release the locking pin 808 from the locking slots 810 and the arm 802 is pulled outward until fully disengaged from the support structure 100. To replace or insert a pipe rack extension arm 802, the process is reversed.

Figure 9A:
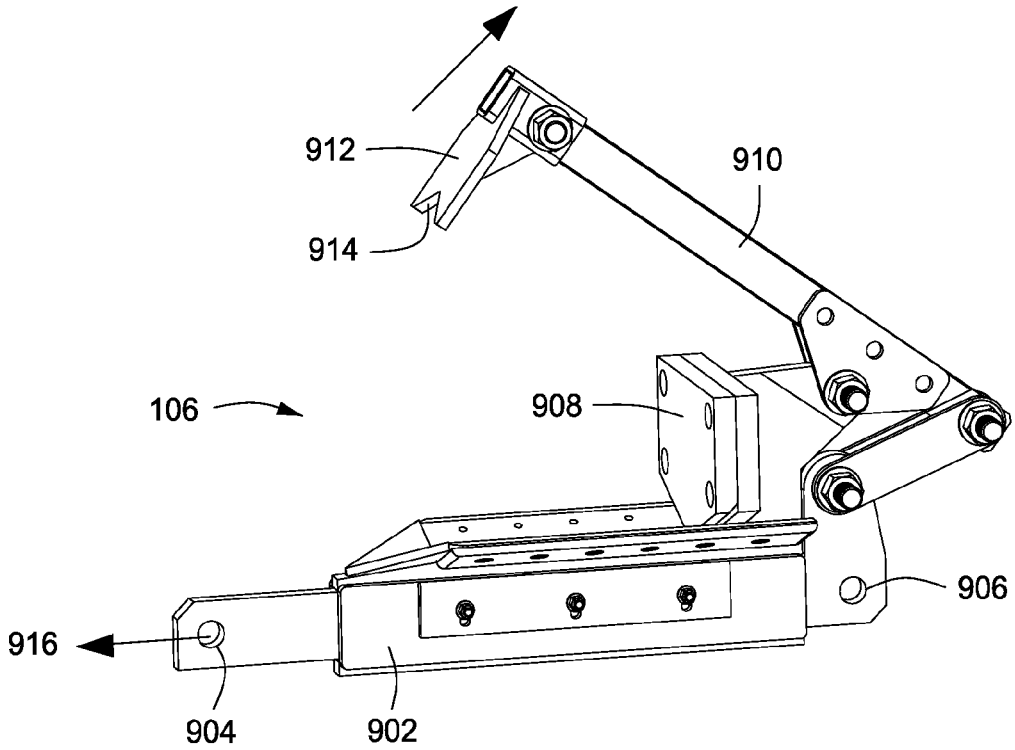
FIGS. 9A and 9B are perspective views of a portion of the apparatus shown in FIG. 1.
Figure 9B:
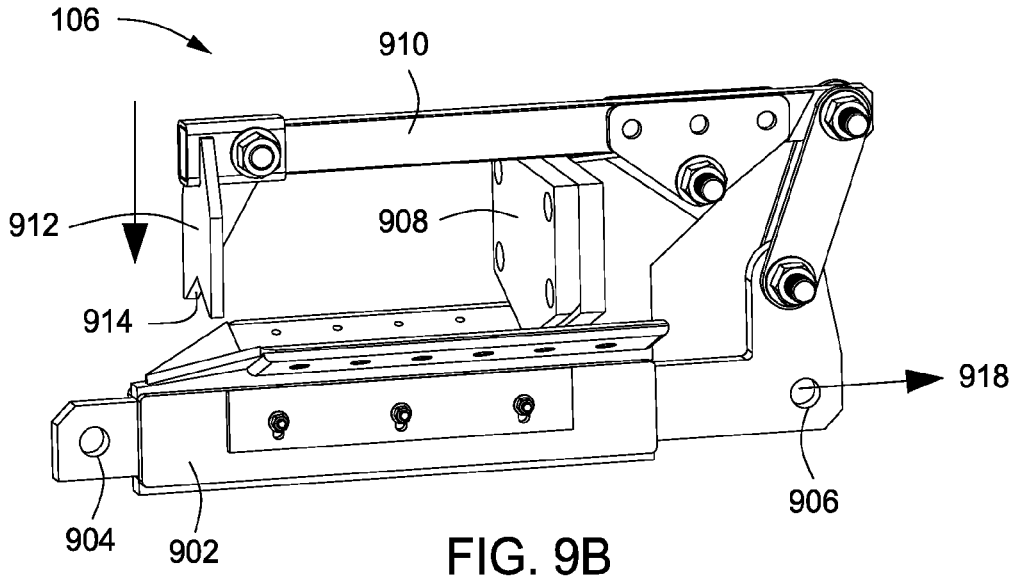

Referring to FIGS. 9A and 9B, the skate 106 comprises a slide 902 configured to engage and ride along a substantial length of the slot 104 inside the elongate indentation 102. In an exemplary embodiment, the slide end points 904, 906 are coupled to a drive system (such as the drive system 110 described above with reference to FIG. 1). In an exemplary embodiment, the drive system 110 is powered by a hydraulic winch and cable apparatus. The cable can be actuated to pull the skate 106 forward and/or backward, thereby pushing and/or pulling a tubular member along the elongate indentation 102 and up and/or down the ramp assembly 108.

The skate 106 further comprises a pipe stop member 908 configured to abut the end of a tubular member and push it axially along the elongate indentation 102. The skate 106 may also be configured to pull a tubular member by employing a grabber arm 910. The grabber arm 910 may comprise a pipe fork 912 that may be configured to clamp down on the tubular member. The return portion 914 of the pipe fork 912 may be tapered so as to engage the tubular member proximate a tapered change in diameter of a pipe joint connection. This tapered portion 914 may prove useful when attempting to pull soiled and/or oily tubular members that would normally slip from a flat pulling engagement device.

In operation, the grabber arm 910 may engage or release automatically when the skate 106 is pulling or pushing a tubular member, respectively. For example, pulling the skate 106 in the direction 916 may cause the grabber aim 910 to rotate upward, allowing a tubular member to be pushed while abutted to the pipe stop member 908. In the alternative, pulling the skate 106 in the direction 918 may engage the grabber arm 910 downwardly thereby clamping on to a tubular member.

Figure 10:
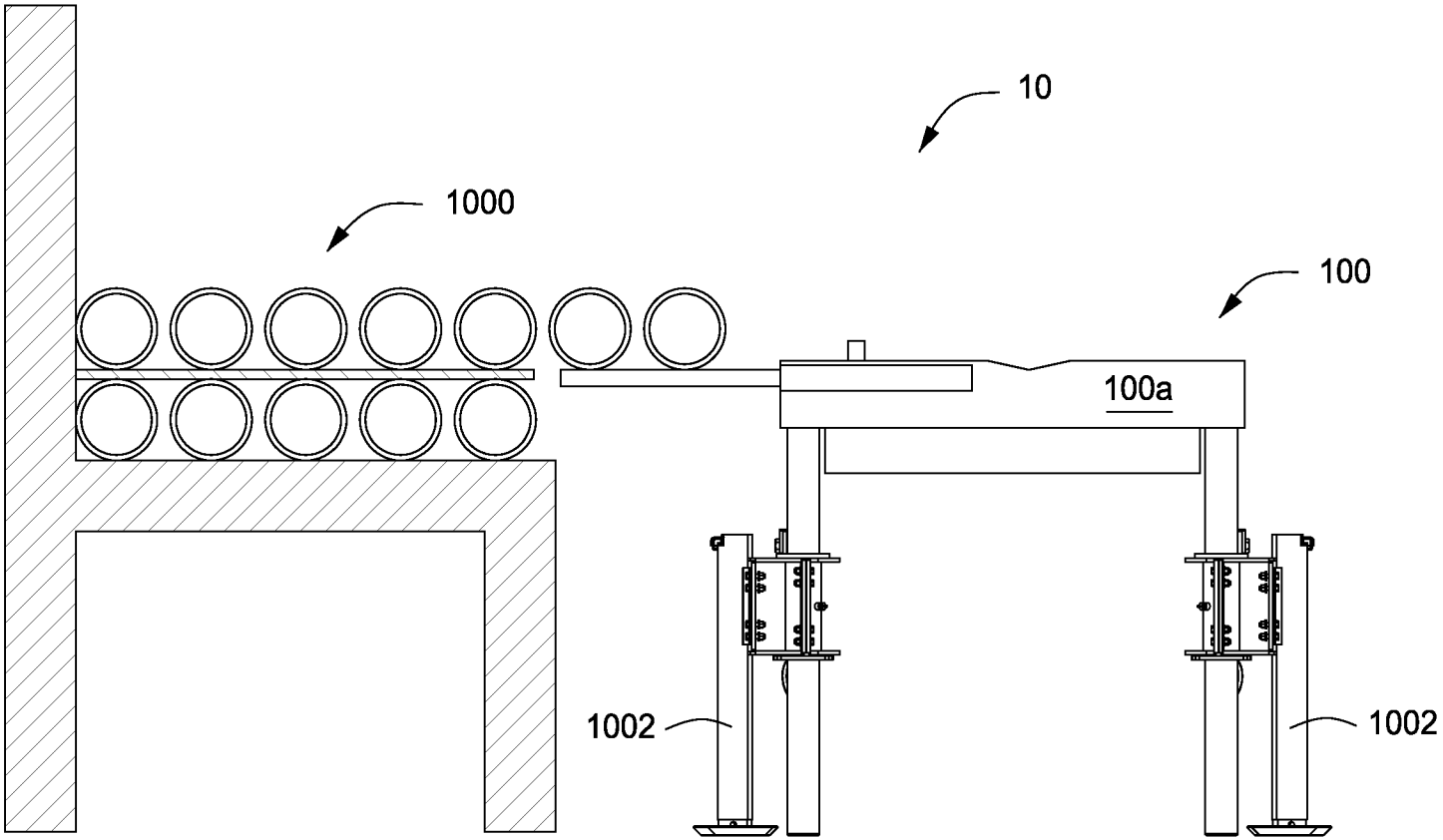
FIG. 10 is a portion of the apparatus shown in FIG. 1.

FIG. 10 illustrates the apparatus 10 in a configuration for loading and unloading tubular elements to and from a storage rack 1000. The base of the support structure 100 includes actuators 1002 independently operable to adjust the height and angle of the upper surface 100*a* of the support structure 100 relative to the underlying terrain. Moreover, the actuators 1002 may also function to align the upper surface 100*a* with an adjacent storage rack 1000. In an exemplary embodiment, the support structure 100 may comprise at least four actuators 1002, consisting of hydraulically-operable linear actuators, pneumatic actuators, and/or geared electric motor actuators.

An apparatus capable of moving a tubular member to and from an elevated drilling rig floor has been described. The apparatus may comprise a support structure having a generally horizontal upper surface and an elongate indentation extending longitudinally along the upper surface. It may also comprise a ramp assembly having first and second telescoping assemblies, each having a plurality of nested tubular elements. The first end of the first telescoping assembly can be positionally fixed relative to a first end of the second telescoping assembly. A second end of the first telescoping assembly may be detachably coupled to a second end of the second telescoping assembly. The second ends of the first and second telescoping assemblies can extend between a retracted position and a deployed position proximate a drilling rig floor at a variable height relative to the upper surface of the support structure. The first and second telescoping assemblies collectively may form at least a portion of an elongate guide extending from the elongate indentation towards the drilling rig floor.

An apparatus has also been described that comprises a plurality of indexers mounted in a corresponding plurality of recesses in an upper surface of a support structure that are cooperatively operable to urge a tubular member towards or away from an elongate indentation in the upper surface of the support structure. The apparatus further comprises a plurality of kickers, each operably coupled to a corresponding one of the plurality of indexers and are operable to urge the tubular member out of the elongate indentation. Moreover, a plurality of first and second actuators and corresponding indexers have been described, wherein each first actuator is operable to raise and lower an outer end of a corresponding indexer relative to the upper surface of the support structure and each second actuator is operable to raise and lower an inner end of a corresponding indexer relative to the upper surface of the support structure. Each second actuator is further operable to deploy and stow a corresponding kicker simultaneously with the raising and lowering, respectively, of the inner end of a corresponding indexer.

A method for moving a tubular member relative to a drilling rig floor has also been disclosed, the method comprising operating a plurality of indexers mounted in a corresponding plurality of recesses in an upper surface of a support structure to urge the tubular member towards or away from an elongate indentation in the upper surface of the support structure. The method further comprises operating a skate mechanism to move the tubular member within the elongate indentation and within an elongate guide of a ramp assembly, wherein the ramp assembly comprises first and second telescoping assemblies each having a plurality of nested tubular elements and extendable between a retracted position and a deployed position that is proximate the drilling rig floor.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An apparatus, comprising:

a plurality of indexers mounted in a corresponding plurality of recesses in an upper surface of a support structure and cooperatively operable to urge a tubular member towards or away from an elongate indentation in the upper surface of the support structure;

a plurality of kickers each operably coupled to a corresponding one of the plurality of indexers and operable to urge the tubular member into or out of the elongate indentation; and a plurality of first and second actuators, wherein each first actuator is operable to raise and lower an outer end of a corresponding one of the plurality of indexers relative to the upper surface of the support structure and also relative to a corresponding one of the plurality of kickers, each second actuator is operable to raise and lower an inner end of a corresponding one of the plurality of indexers relative to the upper surface of the support structure, and each second actuator is further operable to deploy and stow a corresponding one of the plurality of kickers simultaneously with the raising and lowering, respectively, of the inner end of a corresponding one of the plurality of indexers.

2. The apparatus of claim 1, wherein each of the plurality of first and second actuators comprises a hydraulically-operable linear actuator.

3. The apparatus of claim 1, wherein each of the plurality of kickers retracts into a corresponding recess in the elongate indentation when stowed and protrudes into the elongate indentation when deployed.

4. The apparatus of claim 1, further comprising a plurality of stop pins positioned at spaced-apart locations along outer edges of the support structure and operable to prevent the tubular member from rolling past the outer edges of the support structure.

5. The apparatus of claim 4, wherein each of the plurality of stop pins is removably detachable.

6. The apparatus of claim 1, further comprising indexer pipe rollers configured to align the tubular members fore and aft prior to indexing.

7. The apparatus of claim 1, wherein the plurality of kickers and the plurality of indexers collectively comprises a plurality of hydraulically-operable linear actuators each configured to simultaneously operate one of the plurality of indexers and a corresponding one of the plurality of kickers.

8. The apparatus of claim 1, further comprising a skate mechanism operable to move the tubular member within the elongate indentation.

9. The apparatus of claim 8, wherein the skate mechanism further comprises a grabbing member operable to engage or push the tubular member in connection with movement of the skate mechanism.

10. The apparatus of claim 9, wherein the grabbing member comprises a forked portion configured to engage the tubular member.

11. The apparatus of claim 1, further comprising a ramp assembly comprising first and second side-by-side telescoping assemblies each having at least one outer surface and formed of a plurality of nested tubular elements, wherein: a first end of the first telescoping assembly is positionally fixed relative to a first end of the second telescoping assembly; a second end of the first telescoping assembly is detachably coupled to a second end of the second telescoping assembly; the second ends of the first and second telescoping assemblies are extendable between a retracted position and a deployed position proximate the drilling rig floor at a variable height relative to the upper surface of the support structure; and the at least one outer surface of each of the first and second telescoping assemblies are adjacent and collectively form at least a portion of an elongate guide extending from the elongate indentation towards the drilling rig floor.

12. The apparatus of claim 11, wherein the first and second telescoping assemblies form a first portion of the elongate guide, and wherein the ramp assembly further comprises a wedge ramp forming a second portion of the elongate guide extending between the elongate indentation and the first portion of the elongate guide.

13. The apparatus of claim 1, further comprising a plurality of pipe rack extension arms having first and second ends and configured to extend from the support structure at various lengths and to retract into corresponding recesses in the support structure when not in use.

* * * * *